US010615478B2

(12) United States Patent
Forati

(10) Patent No.: US 10,615,478 B2
(45) Date of Patent: Apr. 7, 2020

(54) CO-FIRED CERAMIC WAVEGUIDE FEEDING NETWORKS FOR MILLIMETER WAVES

(71) Applicant: TDK Corporation, Tokyo (JP)

(72) Inventor: Ebrahim Forati, San Jose, CA (US)

(73) Assignee: TDK Corporation, Tokyo (JP)

( * ) Notice: Subject to any disclaimer, the term of this patent is extended or adjusted under 35 U.S.C. 154(b) by 102 days.

(21) Appl. No.: 15/986,554

(22) Filed: May 22, 2018

(65) Prior Publication Data

US 2019/0363454 A1 Nov. 28, 2019

(51) Int. Cl.
*H01P 3/12* (2006.01)
*H01P 3/16* (2006.01)

(52) U.S. Cl.
CPC ..... *H01P 3/121* (2013.01); *H01P 3/122* (2013.01); *H01P 3/16* (2013.01)

(58) Field of Classification Search
CPC .. H01P 3/12; H01P 3/121; H01P 3/122; H01P 3/123; H01P 3/16; H01P 3/18; H01P 1/2002; H01P 1/2084; H01P 1/2138
USPC ..... 333/208, 209, 210, 211, 212, 239, 241, 333/242, 248, 249
See application file for complete search history.

(56) References Cited

U.S. PATENT DOCUMENTS 6,515,562 B1 * 2/2003 Takenoshita ..... H01P 3/121 333/248
7,142,074 B2 * 11/2006 Kim ..... H01P 1/207 333/208
9,985,331 B2 * 5/2018 Boutayeb ..... H01P 3/121
2018/0269557 A1 * 9/2018 Fangfang ..... H01P 3/123

* cited by examiner

*Primary Examiner* — Rakesh B Patel
*Assistant Examiner* — Jorge L Salazar, Jr.
(74) *Attorney, Agent, or Firm* — Hamilton, Brook, Smith & Reynolds, P.C.

(57) ABSTRACT

In accordance with an embodiment of the present disclosure, there is provided a technique of using probe fed apertures to realize a waveguide feeding network that can be divided both parallel to the surface, and on different levels, of a co-fired ceramic substrate, such as a low temperature co-fired ceramic (LTCC) substrate. A horizontal feed network is divided into several sections, which can be stacked vertically in various different locations and on different layers within the substrate, and are connected by probe-fed apertures. In this way, waveguide dividing can be performed in directions that are parallel to the surface of the substrate and on different levels of the substrate, thereby increasing the efficiency of the use of the substrate volume and permitting dividing and combining of inputs and outputs in a more flexible manner.

20 Claims, 10 Drawing Sheets

FIG. 8A
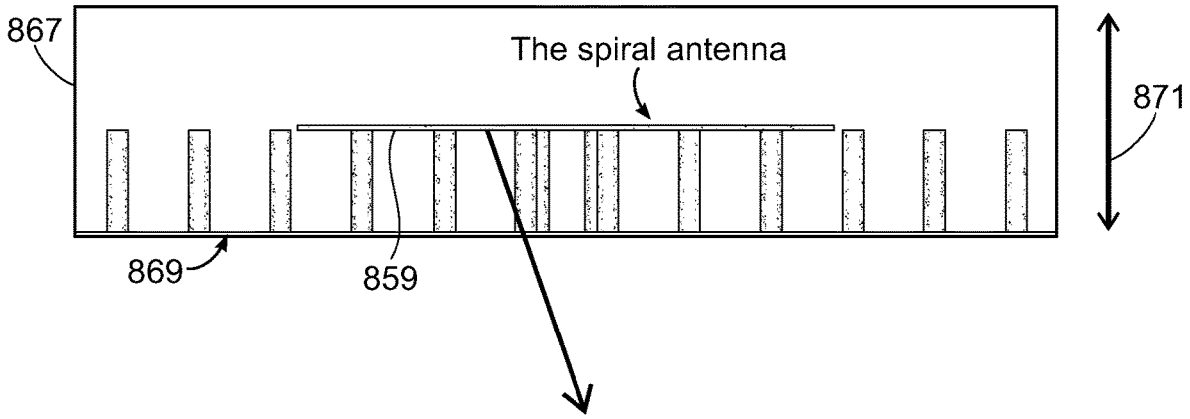
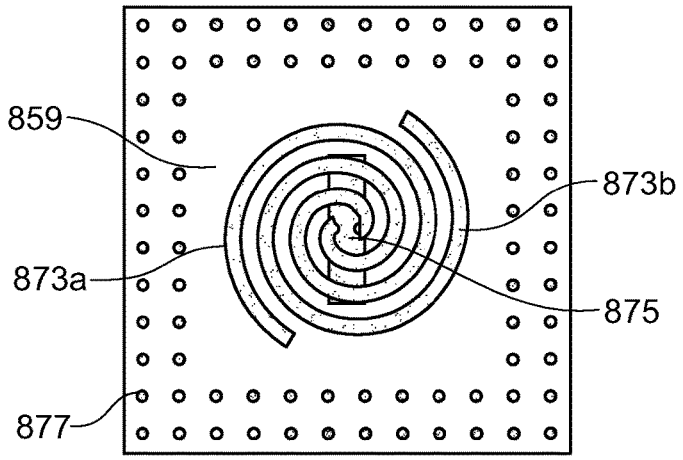
FIG. 8B

CO-FIRED CERAMIC WAVEGUIDE FEEDING NETWORKS FOR MILLIMETER WAVES

BACKGROUND

Waveguide feeding networks are used to guide waves into other devices, and can perform functions such as dividing and combining of waves propagated through waveguide channels within the waveguide feeding network. Typical waveguide feeding networks, implemented in materials such as low temperature co-fired ceramics (LTCC), include junctions such as T-junctions, Y-junctions and cross-junctions, either in a vertical direction along the thickness of the substrates, that is, in the normal (or perpendicular) direction to the surface of the substrate, or as a single horizontal layer, parallel to the surface. In such conventional methods of fabricating such waveguide feeding networks, the dividing or combining function can be performed only in the one direction, either in the normal direction or in a single layer parallel to the surface of the substrate, which imposes a limitation on the maximum size of the feeding network due to the limited available substrate thickness. There is, therefore, an ongoing need for improved designs of waveguide feeding networks implemented in co-fired ceramics.

SUMMARY

In accordance with an embodiment of the present disclosure, there is provided a technique of using probe fed apertures to realize a waveguide feeding network that can be divided both parallel to the surface, and on different levels, of a co-fired ceramic substrate, such as a low temperature co-fired ceramic (LTCC) substrate. A horizontal feed network is divided into several sections, which can be stacked vertically in various different locations and on different layers within the substrate, and are connected by probe-fed apertures. In this way, waveguide dividing can be performed in directions that are parallel to the surface of the substrate and on different levels of the substrate, thereby increasing the efficiency of the use of the substrate volume and permitting dividing and combining of inputs and outputs in a more flexible manner. The wave polarization can be controlled much more easily than in existing techniques.

In one embodiment according to the present disclosure, there is provided a co-fired ceramic waveguide device for guiding electromagnetic waves, such as millimeter wavelength electromagnetic waves. The device includes a co-fired ceramic substrate including a thickness, in a normal direction perpendicular to at least one surface of the device, that is less than a width of the co-fired ceramic substrate in a direction parallel to the surface of the device. The co-fired ceramic substrate includes at least one waveguide channel aperture formed within the co-fired ceramic substrate, such as a waveguide channel aperture that includes a width less than about 1 centimeter. A first waveguide channel aperture is formed in the at least one waveguide channel aperture and extends along at least a portion of a first waveguide channel level of at least two different waveguide channel levels, and a second waveguide channel aperture is formed in the at least one waveguide channel aperture and extends along at least a portion of a second waveguide channel level of the at least two different waveguide channel levels. The at least two different waveguide channel levels are at different levels in the normal direction within the co-fired ceramic substrate. The co-fired ceramic substrate further includes at least one waveguide probe formed within the co-fired ceramic substrate, opening at a first probe end into the first waveguide channel aperture, and opening at a second probe end into the second waveguide channel aperture. At least one of the first waveguide channel aperture and the second waveguide channel aperture are divided into more than one waveguide channel branches extending along a same level of the at least two different waveguide channel levels and extending in a direction parallel to the at least one surface of the device.

In further, related embodiments, the at least one waveguide probe may be formed in an axially symmetric manner about an axis extending between the first waveguide channel level and the second waveguide channel level. The at least one waveguide probe may be formed to include a stem. The at least one waveguide probe may be formed to include at least one cap. The at least one cap may be formed to include a cap opening onto the first probe end, and the stem may be formed to open onto the second probe end. The at least one cap may be formed to include a first cap opening onto the first probe end, and to include a second cap opening onto the second probe end. The at least one cap may include a width of greater than about 200 microns, the stem may include a diameter of less than about 200 microns, and the stem may include a length of less than about 700 microns. The at least one cap may include a width of greater than about 300 microns, and the stem may include a diameter of less than about 100 microns. The more than one waveguide channel branches may be formed to include at least one of: a T-shaped junction of more than one waveguide channel branches, a Y-shaped junction of more than one waveguide channel branches, and a cross-shaped junction of more than one waveguide channel branches. The at least one waveguide channel aperture may be formed to include a width less than about 1 millimeter. The at least one waveguide channel aperture may include a width between about 300 microns and about 700 microns.

In other related embodiments, the device may further include at least one waveguide input aperture formed in the co-fired ceramic substrate and at least one waveguide output aperture formed in the co-fired ceramic substrate; and the at least one waveguide input aperture, the at least one waveguide probe, the at least one waveguide channel aperture and the at least one waveguide output aperture may be formed to together include a waveguide network connecting the at least one waveguide input aperture with the at least one waveguide output aperture. The device may, for example, include one waveguide input aperture and at least one of: eight waveguide output apertures, sixteen waveguide output apertures and thirty-two waveguide output apertures. The device may include one waveguide output aperture and at least one of: eight waveguide input apertures, sixteen waveguide input apertures and thirty-two waveguide input apertures. The device may further include at least one millimeter wave antenna coupled to the at least one waveguide output aperture of the co-fired ceramic substrate. The at least one waveguide probe may be formed to couple at least one of the at least one waveguide input aperture and the at least one waveguide output aperture to at least one of: a different one of the at least one waveguide input aperture, a different one of the at least one waveguide output aperture, and the at least one waveguide channel aperture. The at least one millimeter wave antenna and the at least one waveguide input aperture may be formed in a different level of the at least two different waveguide channel levels. The device may include a plurality of co-fired substrate layers each including at least one ceramic material, the plurality of co-fired ceramic layers being stacked in the normal direction and each ceramic layer being less than about 100 microns in thickness, the plurality of co-fired ceramic layers being integrated by having been co-fired at a temperature less than about 1000° C. The thickness of the device in the normal direction may, for example, be less than about 5 millimeters.

In another embodiment according to the present disclosure, there is provided a method of transmitting electromagnetic waves, such as millimeter wavelength electromagnetic waves, through a co-fired ceramic waveguide device. The method includes transmitting the electromagnetic waves through at least one waveguide channel aperture within a co-fired ceramic substrate. The at least one waveguide channel aperture may include a width less than about 1 centimeter. The co-fired ceramic substrate includes a thickness, in a normal direction perpendicular to at least one surface of the device that is less than a width of the co-fired ceramic substrate in a direction parallel to the surface of the device. The transmitting through the at least one waveguide channel aperture includes transmitting the electromagnetic waves through a first waveguide channel aperture extending along at least a portion of a first waveguide channel level of at least two different waveguide channel levels, and transmitting the electromagnetic waves through a second waveguide channel aperture extending along at least a portion of a second waveguide channel level of the at least two different waveguide channel levels. The at least two different waveguide channel levels are at different levels in the normal direction within the co-fired ceramic substrate. The method includes transmitting the electromagnetic waves through at least one waveguide probe within the co-fired ceramic substrate, the at least one waveguide probe opening at a first probe end into the first waveguide channel aperture, and opening at a second probe end into the second waveguide channel aperture. The method further includes transmitting the electromagnetic waves through more than one waveguide channel branches of at least one of the first waveguide channel aperture and the second waveguide channel aperture, the more than one waveguide channel branches extending along a same level of the at least two different waveguide channel levels and extending in a direction parallel to the at least one surface of the device.

In further, related embodiments, the method may include transmitting the electromagnetic waves through a waveguide network of the device, the waveguide network including at least one waveguide input aperture of the device, at least one waveguide output aperture of the device, the at least one waveguide probe, and the at least one waveguide channel aperture. The method may include at least one of: dividing the electromagnetic waves between the at least one waveguide input aperture and the at least one waveguide output aperture, and combining the electromagnetic waves between the at least one waveguide input aperture and the at least one waveguide output aperture. For example, the method may include dividing the electromagnetic waves between the at least one waveguide input aperture and the at least one waveguide output aperture into at least one of eight output apertures, sixteen output apertures and thirty-two output apertures; and may include combining the electromagnetic waves between the at least one waveguide input aperture and the at least one waveguide output aperture from at least one of eight input apertures, sixteen input apertures and thirty-two input apertures.

In other related embodiments, the method may include transmitting the electromagnetic waves from the at least one waveguide output aperture into at least one millimeter wave antenna. The method may include transmitting, through the waveguide network, the electromagnetic waves from the at least one waveguide input aperture to the at least one waveguide output aperture, which is coupled to the at least one millimeter wave antenna, wherein the at least one millimeter wave antenna and the at least one waveguide input aperture are formed in a different level of the at least two different waveguide channel levels. The method may include transmitting the electromagnetic waves with a different electric field polarization through at least one of the at least one waveguide output apertures as compared with at least one of the at least one waveguide input apertures. The method may further include transmitting the electromagnetic waves through the at least one waveguide probe between at least one of the at least one waveguide input aperture and the at least one waveguide output aperture and at least one of: a different one of the at least one waveguide input aperture, a different one of the at least one waveguide output aperture, and the at least one waveguide channel aperture. The method may include transmitting the electromagnetic waves with a frequency between about 30 GHz and about 300 GHz, such as with a frequency between about 30 GHz and about 110 GHz, or with a frequency between about 110 GHz and about 300 GHz.

In further related method embodiments, the at least one waveguide probe may be axially symmetric about an axis extending between the first waveguide channel level and the second waveguide channel level. The at least one waveguide probe may include at least one cap and a stem. The at least one cap may include a cap opening onto the first probe end, and the stem may open onto the second probe end. The at least one cap may include a first cap opening onto the first probe end, and a second cap opening onto the second probe end. The at least one cap may include a width of greater than about 200 microns, the stem may include a diameter of less than about 200 microns, and the stem may include a length of less than about 700 microns. The at least one cap may include a width of greater than about 300 microns, and the stem may include a diameter of less than about 100 microns. The more than one waveguide channel branches may include at least one of: a T-shaped junction of more than one waveguide channel branches, a Y-shaped junction of more than one waveguide channel branches, and a cross-shaped junction of more than one waveguide channel branches. The least one waveguide channel aperture may include a width less than about 1 millimeter. The at least one waveguide channel aperture may include a width between about 300 microns and about 700 microns. The co-fired ceramic substrate may include a plurality of co-fired substrate layers each including at least one ceramic material, the plurality of co-fired ceramic layers being stacked in the normal direction and each ceramic layer being less than about 100 microns in thickness, the plurality of co-fired ceramic layers being integrated by having been co-fired at a temperature less than about 1000° C. The thickness of the device in the normal direction may, for example, be less than about 5 millimeters.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

FIG. 5A illustrates a Y-junction, FIG. 5B illustrates a T-junction and FIG. 5C illustrates a cross junction.

FIG. 8A is a schematic side view diagram of a spiral millimeter wave antenna to which a co-fired ceramic device may be coupled, and FIG. 8B is a schematic top view diagram of such a spiral millimeter wave antenna, in accordance with an embodiment of the present disclosure.

DETAILED DESCRIPTION

A description of example embodiments follows.

Figure 1:
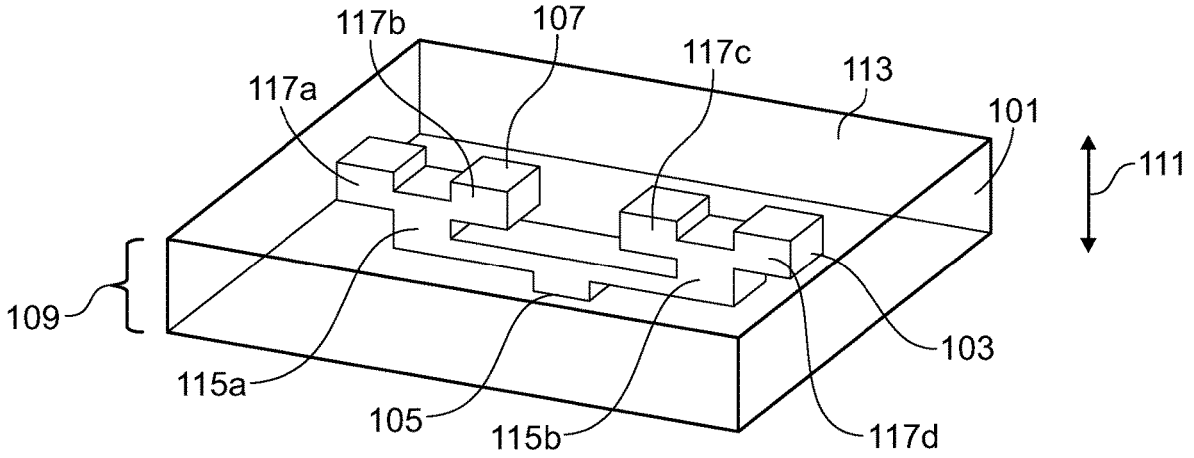
FIG. 1 (PRIOR ART)
FIG. 1 is a schematic diagram of a millimeter wave waveguide feeding network implemented in a co-fired ceramic material, in accordance with the prior art.

FIG. 1 is a schematic diagram of a millimeter wave waveguide feeding network implemented in a co-fired ceramic substrate, such as a low temperature co-fired ceramic (LTCC) material, in accordance with the prior art. Within the LTCC substrate 101, a waveguide network 103 extends between one or more waveguide input apertures 105 and one or more waveguide output apertures 107. Such typical waveguide feeding networks 103 in LTCC materials include junctions such as T-junctions, Y-junctions and cross-junctions, in only one direction—for example, along the thickness 109 of the substrate, that is, in the normal direction (perpendicular direction) 111 to the surface 113 of the substrate, or in a single horizontal layer. In the example of FIG. 1, there is shown a conventional LTCC waveguide feeding network that uses only Y-junctions in the normal direction 111. A first Y-junction divides into two branches 115*a*, 115*b* in a first level of dividing. Then two more Y-junctions, in turn, divide those two branches 115*a*, 115*b* into a total of four branches 117*a*, 117*b*, 117*c* and 117*d*, in a second level of dividing. As can be seen, the dividing is only performed in the normal direction 111 to the surface 113. That is, progressing through the thickness 109 of the substrate in the normal direction 111 from the input aperture 105 to the output aperture 107, the number of branches of the waveguide feeding network 103 only increases in the normal direction 111, for example, here, from one branch at input aperture 105 to two branches 115*a*, 115*b* and then to four branches 117*a-d* as one proceeds in the normal direction 111. Other conventional techniques use only a single horizontal layer of dividing. In such conventional methods of fabricating such waveguide feeding networks, the dividing can be performed only in the one direction, either in the normal direction 111 or in a single layer in the horizontal direction, which imposes a limitation on the maximum size of the feeding network due to the limited available LTCC substrate thickness. For example, in FIG. 1, between input aperture 105 and output apertures 107, there is only room for two stages of divisions to create a total of four branches 117*a-d*, within the available depth of the thickness 109 of the substrate.

Figure 2:
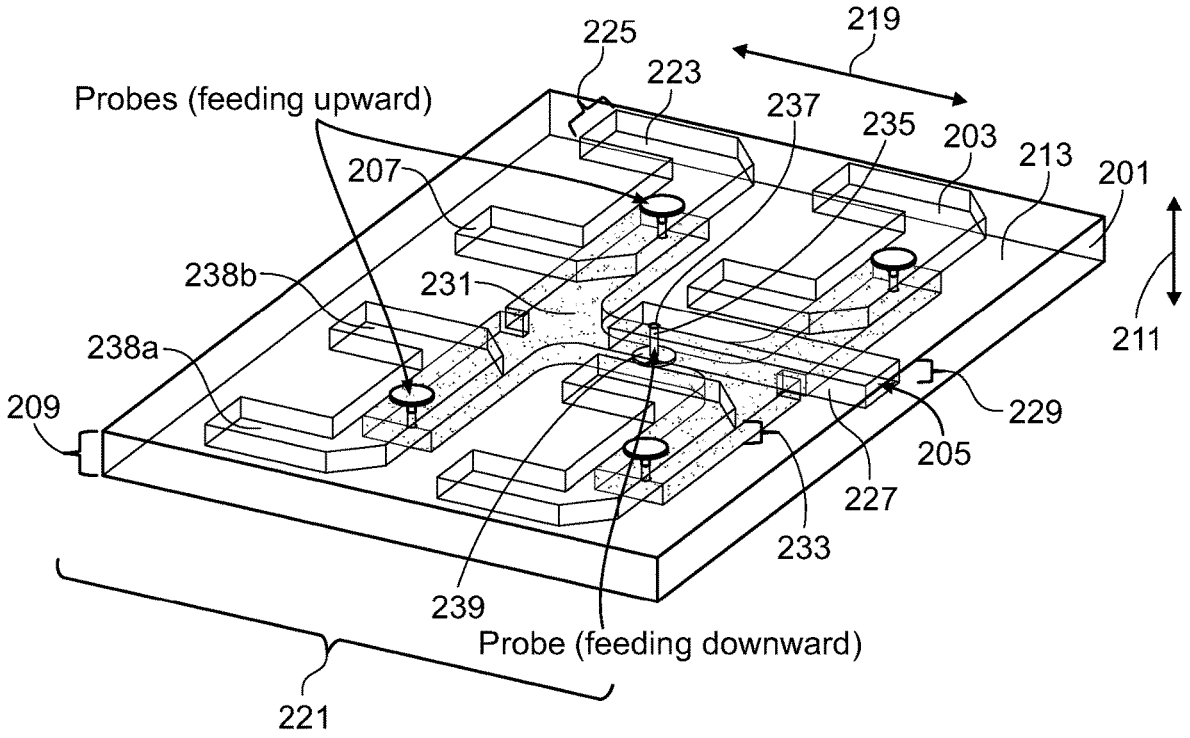
FIG. 2 is a schematic diagram of a millimeter wave feeding network implemented in a co-fired ceramic material, in accordance with an embodiment of the present disclosure.

FIG. 2 is a schematic diagram of a millimeter wave feeding network implemented in a co-fired ceramic material, such as a low temperature co-fired ceramic (LTCC) material, in accordance with an embodiment of the present disclosure. Using probe-coupled apertures, a waveguide feeding network is realized that can be divided both parallel to the surface, and on different levels, of a co-fired ceramic substrate, such as a low temperature co-fired ceramic (LTCC) substrate. A horizontal feed network is divided into several sections, which can be stacked vertically in various different locations and on different layers within the substrate, and are connected by probe-fed apertures. In this way, waveguide dividing can be performed in directions that are parallel to the surface of the substrate and on different levels of the substrate, thereby increasing the efficiency of the use of the substrate volume and permitting dividing and combining of inputs and outputs in a more flexible manner. A compact design that uses substrate volume efficiently is thereby provided. Ideally, a designer can thereby use nearly all, or at least as much as is feasible, of the substrate volume.

In more detail, with reference to the embodiment of FIG. 2, the co-fired ceramic waveguide device includes a co-fired ceramic substrate 201 extending in a planar fashion, in a parallel direction 219 to at least one surface 213 of the device. The substrate 201 extends in a normal direction 211 perpendicular to the surface 213 of the device. A thickness 209 of the device in the normal direction 211 is less than a width 221 of the device in a direction 219 parallel to the surface of the device. The device can be used for guiding millimeter wavelength electromagnetic waves. At least one waveguide channel aperture 223 is formed within the co-fired ceramic substrate 201 and includes a width 225 less than about 1 centimeter, such as less than about 1 millimeter, or such as between about 300 microns and about 700 microns. The waveguide channel apertures 223 is formed to include a first waveguide channel aperture 227 extending along at least part of a first waveguide channel level 229, and a second waveguide channel aperture 231 extending along at least part of a second waveguide channel level 233. It will be appreciated that there can be two or more different waveguide channel levels 229, 233, which are at different levels in the normal direction 211 within the co-fired ceramic substrate 201.

Continuing with reference to the embodiment of FIG. 2, at least one waveguide probe 235 is formed within the co-fired ceramic substrate 201. The waveguide probe 235 opens at a first probe end 237 into the first waveguide channel aperture 227, and opens at a second probe end 239 into the second waveguide channel aperture 231. In this way, the waveguide probe 235 joins the first waveguide channel aperture 227, which is on the first waveguide channel level 229, with the second waveguide channel aperture 231, which is on the second waveguide channel level 233, and permits millimeter waves to be propagated from one level 229 to the other 233 within the waveguide network 203. At least one of the first waveguide channel aperture 227 and the second waveguide channel aperture 231 divide into more than one waveguide channel branches, such as in the fashion of branches 238*a*, 238*b* in FIG. 2, which extend along the same level 229 of the at least two different waveguide channel levels 229, 233 and extend in a direction parallel 219 to the surface 213 of the device. Because the waveguide channel is divided into branches that extend along the same level 229, and because the different levels 229 and 233 can be joined using the waveguide probes 235, an embodiment according to the present disclosure thereby permits optimal use of the volume of the substrate 201 by waveguide channel apertures 227 and 231.

Figure 3:
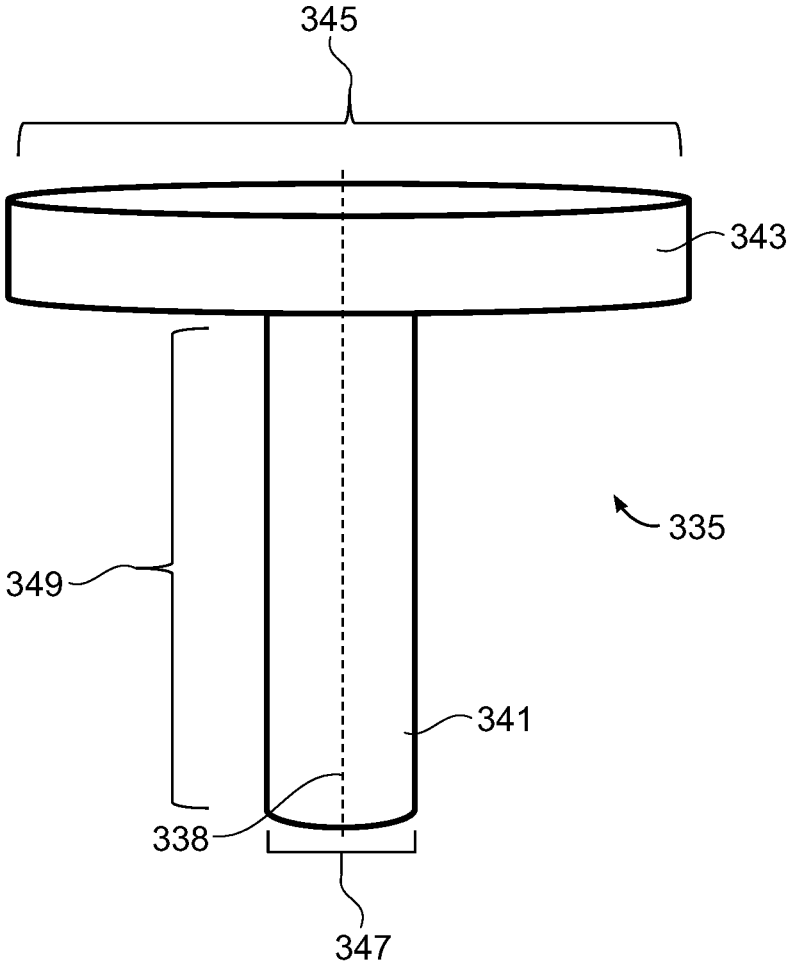
FIG. 3 is a schematic diagram of a first embodiment of a waveguide probe, which can be used in a co-fired ceramic waveguide device in accordance with an embodiment of the present disclosure.

FIG. 3 is a schematic diagram of a first embodiment of a waveguide probe 335, which can be used in a co-fired ceramic waveguide device in accordance with an embodiment of the present disclosure. The waveguide probe 335 may be formed to be axially symmetric about an axis 338 that extends between the first waveguide channel level 229 (see FIG. 2) and the second waveguide channel level 233 (see FIG. 2). For example, in the embodiment of FIG. 3, the waveguide probe 335 is axially symmetric because it is unchanged in appearance if rotated any amount about the axis 338. The waveguide probe 335 is formed to include a stem 341. In addition, the waveguide probe 335 can be formed to include at least one cap 343. In another embodiment, the cap 343 need not be used, in which case there can be only a stem 341, for example if it is determined during impedance matching optimization of a design that a probe 335 without a cap 343 is preferred for impedance matching. The at least one cap 343 (or, if no cap 343 is used, the stem 341) can be formed to open onto the first probe end 237 (see FIG. 2) of the waveguide probe 335, so that it permits a millimeter wave travelling through the probe 335 to be propagated through the first probe end 237 (see FIG. 2) and into a waveguide aperture 227 (see FIG. 2). Similarly, the stem 341 can be formed to open onto the second probe end 239 (see FIG. 2). The at least one cap 343 can, for example, include a width 345 of greater than about 200 microns, the stem 341 may include a diameter 347 of less than about 200 microns, and the stem 341 may include a length 349 of less than about 700 microns. In other examples, the at least one cap 343 can include a width 345 of greater than about 300 microns, and the stem 341 can include a diameter 347 of less than about 100 microns.

Figure 4:
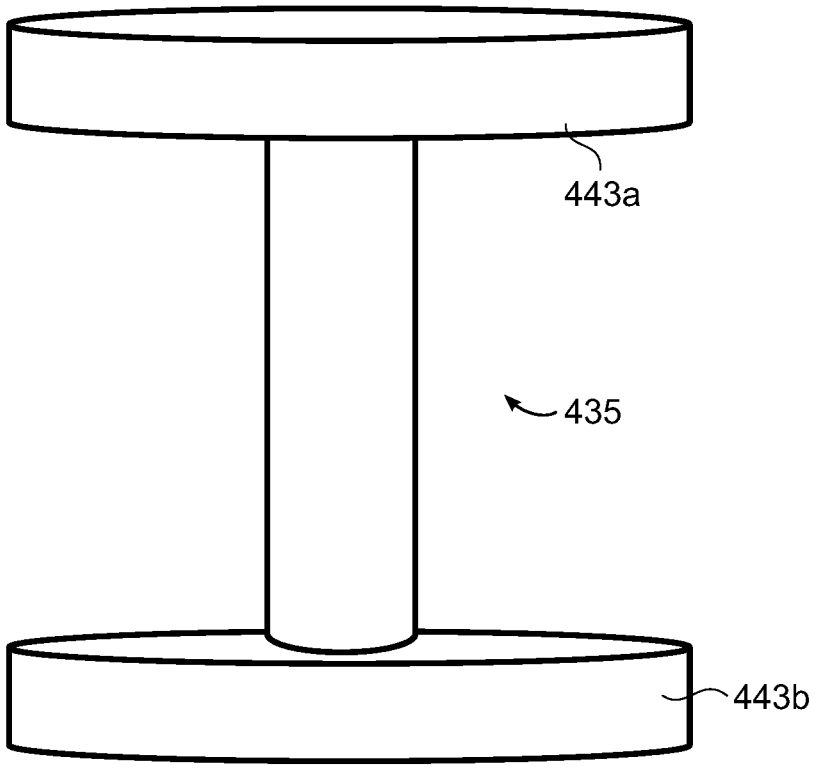
FIG. 4 is a schematic diagram of a second embodiment of a waveguide probe, which can be used in a co-fired ceramic waveguide device in accordance with an embodiment of the present disclosure.

FIG. 4 is a schematic diagram of a second embodiment of a waveguide probe 435, which can be used in a co-fired ceramic waveguide device in accordance with an embodiment of the present disclosure. In the embodiment of FIG. 4, the at least one cap of the waveguide 435 is formed to include a first cap 443*a* opening onto the first probe end 237 (see FIG. 2), and a second cap 443*b* opening onto the second probe end 239 (see FIG. 2). The first and second caps 443*a*, 443*b* can be of different sizes, or can be of the same size.

In accordance with an embodiment of the present disclosure, the sizes of the caps and the stems of the waveguide probes 235 (see FIG. 2), 335 (see FIG. 3) and 435 (of FIG. 4) can be adjusted to match the impedance of the waveguide channels to which the probes are joined. Dimensions such as the diameter and length of the caps, stems, probes, waveguide channel apertures, input apertures and output apertures can all be adjusted appropriately as desired to match and adjust impedances in the waveguide network. For example, the distance from the end of the waveguide (a short circuit) to a waveguide probe, the length of the probe, the thickness of the probe, and the cap size of the probe can all be used to adjust impedances, such as to minimize reflections inside the waveguide. Waveguide channels, inputs, outputs and waveguide probes can, for example, be lined with conductive materials, such as copper or other metals.

Figure 5A:
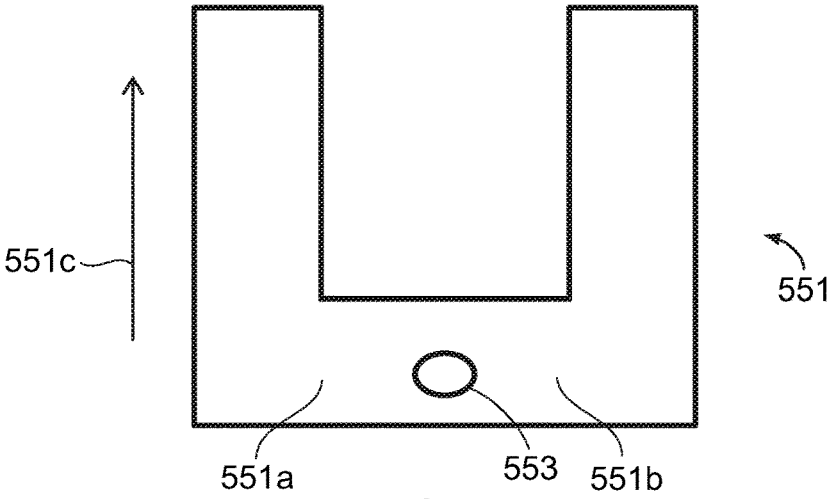
FIGS. 5A-5C are schematic diagrams of junctions of waveguide channel branches, in a co-fired ceramic waveguide device in accordance with an embodiment of the present disclosure.
Figure 5B:
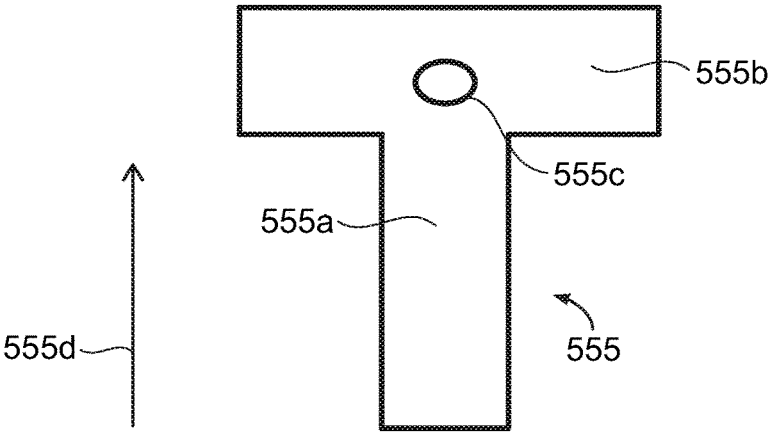
Figure 5C:
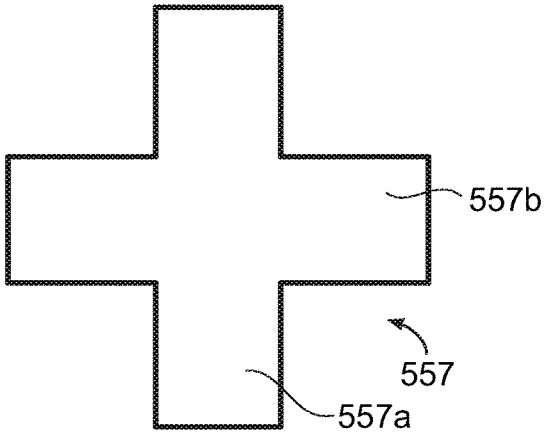

FIGS. 5A-5C are schematic diagrams of junctions of waveguide channel branches, in a co-fired ceramic waveguide device in accordance with an embodiment of the present disclosure. FIG. 5A shows a Y-shaped junction 551 (which can also be viewed as U-shaped), in which a probe 235 (see FIG. 2) enters at location 553. FIG. 5B shows a T-shaped junction 555, and FIG. 5C shows a cross-shaped junction 557. As used herein, a "Y-shaped junction" 551 is a junction in which two waveguide channels 551*a*, 551*b* extend away in opposite directions from an initial entry location 553 of the waveguide junction, and then each turn to extend in the same perpendicular direction 551*c*. As used herein, a "T-shaped junction" 555 is one in which a first waveguide channel 555*a* enters and ends in a second waveguide channel 555*b* that extends perpendicularly to the right and left sides (as viewed going along the first waveguide channel in a direction 555*d*) of the location 555*c* where the first waveguide channel 555*a* enters the second 555*b*. As used herein, a "cross-shaped junction" 557 is one in which two waveguide channels 557*a*, 557*b* meet and cross each other perpendicularly. It will be appreciated that other waveguide channel junctions can be formed in accordance with embodiments of the present disclosure, and that waveguide probes can enter at any of a variety of different locations 553 within the waveguide channel branches and junctions. In the embodiment of FIG. 2, for example, two T-junctions are shown on level 233, whereas four Y-junctions are shown on level 229.

Returning to the embodiment of FIG. 2, the device may further include at least one waveguide input aperture 205 and at least one waveguide output aperture 207 formed in the co-fired ceramic substrate. Here, for example, there is one waveguide input aperture 205 and four waveguide output apertures 207. Together, the one or more waveguide input apertures 205, the waveguide channel apertures 227, 231, the at least one waveguide probe 235 and the one or more waveguide output apertures 207 create a waveguide network 203 connecting the waveguide input aperture 205 with the waveguide output apertures 207. The device can, for example, function as a divider between the waveguide input aperture 205 and the waveguide output apertures 207. For example, the device can include one waveguide input aperture 205 and at least one of: eight waveguide output apertures 207, sixteen waveguide output apertures 207 and thirty-two waveguide output apertures 207; or another number of output apertures 207. Alternatively, the device can, for example, function as a combiner between waveguide input apertures 205 and waveguide output aperture 207. For example, the device may include one waveguide output aperture 207 and at least one of: eight waveguide input apertures 205, sixteen waveguide input apertures 205 and thirty-two waveguide input apertures 205; or another number of input apertures 205. The ability to provide such larger numbers of input apertures 205 or output apertures 207, in accordance with an embodiment of the present disclosure, is created because there is greater room for divisions and combinations within the available depth of the thickness 109 (see FIG. 1) of the substrate, since waveguide dividing can be performed in directions that are parallel to the surface of the LTCC substrate and on different levels. This may provide, for example, an effect of increasing use of the substrate volume and permitting dividing and combining of inputs and outputs in a more flexible manner within a smaller space. In addition, it will be appreciated that the at least one waveguide probe 235 can couple at least one of the at least one waveguide input apertures 205 and the at least one waveguide output aperture 207 to at least one of: a different one of the at least one waveguide input aperture 205 (where there are more than one waveguide input apertures 205), a different one of the at least one waveguide output apertures 207; and can couple to the at least one waveguide channel apertures 227, 231.

Figure 6:
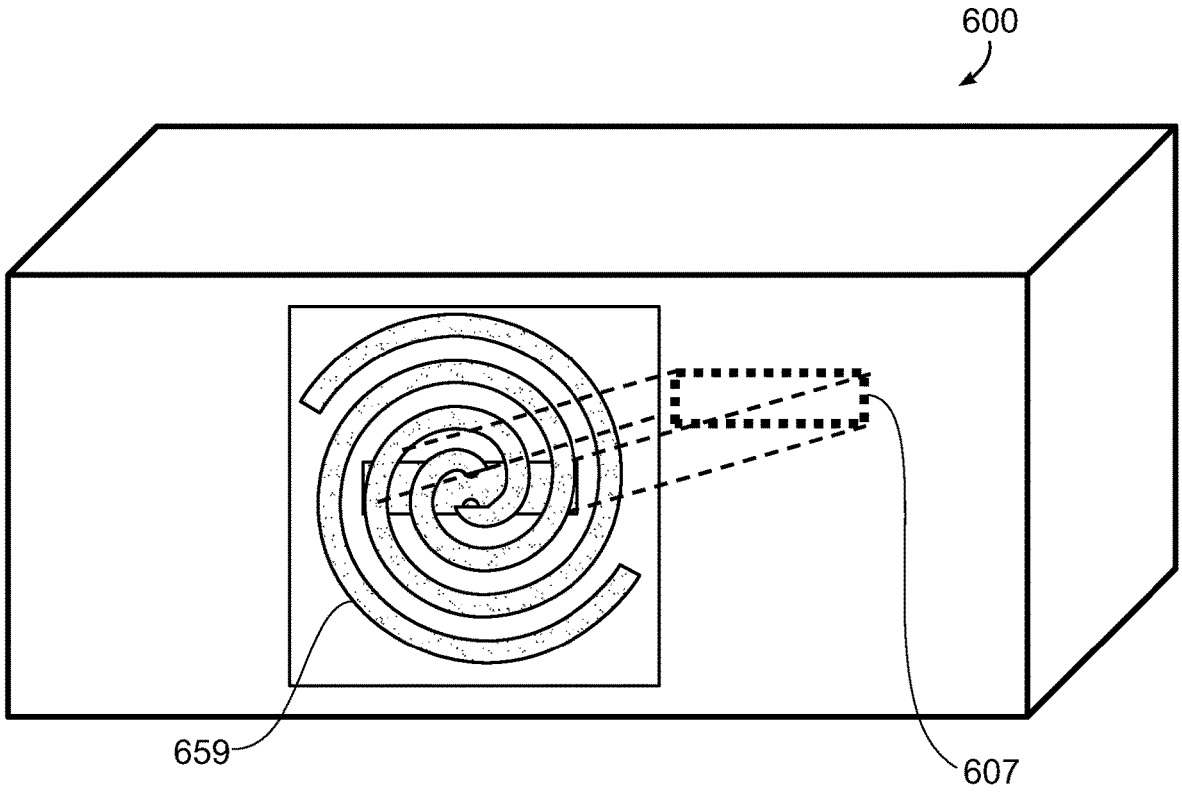
FIG. 6 is a schematic block diagram illustrating coupling of a co-fired ceramic device in accordance with an embodiment of the present disclosure to at least one millimeter wave antenna.

As shown in the schematic block diagram of the embodiment of FIG. 6, the at least one waveguide output aperture 607 of the co-fired ceramic device 600 can be coupled to at least one millimeter wave antenna 659. In this way, the device 600 functions as a waveguide feeding network for the millimeter wave antenna 659, such as a low temperature co-fired ceramic (LTCC) waveguide feeding network for the millimeter wave antenna 659. The co-fired ceramic device 600 and the millimeter wave antenna 659 can be integrated together. An advantage of using a low temperature co-fired ceramic (LTCC) substrate for a millimeter wave waveguide, in accordance with an embodiment of the present disclosure, is that the LTCC material can permit the waveguide device to have a small size. The size of the waveguide device, such as a waveguide feeding network, can shrink by a factor of the square root of the permittivity. Thus, since the LTCC material has a high permittivity, the waveguide feeding network can shrink in size accordingly—for example by a factor of nearly three for a material with a relative permittivity of nearly 9.

Figure 7:
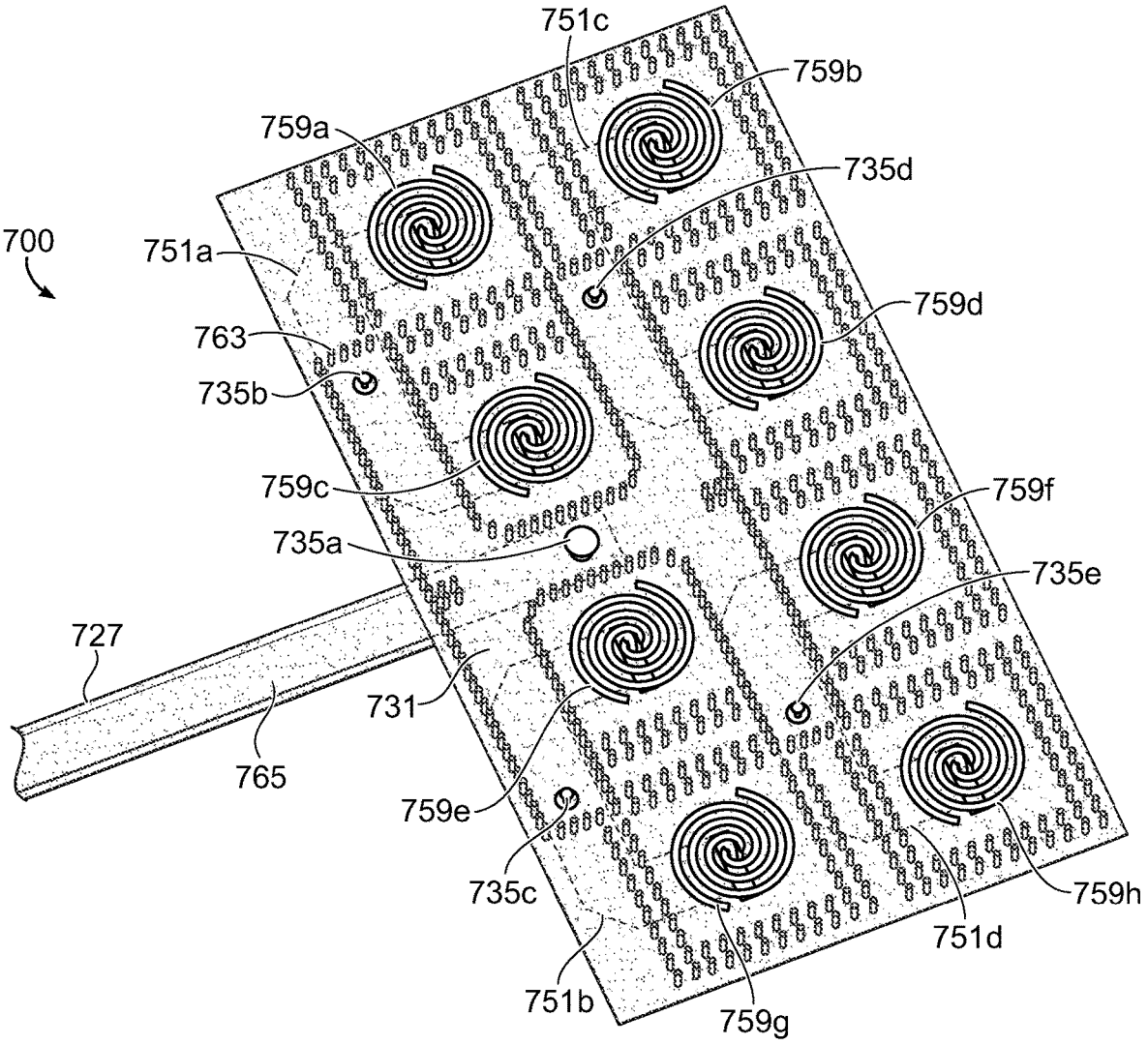
FIG. 7 is a schematic diagram of a co-fired ceramic device serving as a waveguide feeding network for spiral millimeter wave antennas, in accordance with an embodiment of the present disclosure.

FIG. 7 is a schematic diagram of a co-fired ceramic device 700 serving as a waveguide feeding network for spiral millimeter wave antennas 759*a-h*, in accordance with an embodiment of the present disclosure. In this embodiment, it can be seen that the device 700 can be a laminated waveguide in which the side walls of the waveguide channel apertures 727, 731 are formed of metallic vias 763 (also called posts), while metallic sheets 765 serve as the waveguide top and bottom surfaces. In this example, a waveguide channel aperture 727 on a lower level of the device serves as an input channel aperture, with a probe 735*a* feeding upward into a waveguide channel aperture 731 on an upper level of the device that is configured as two T-junctions joined at their bases. The waveguide channel aperture 731 then feeds waves to probes 735*b-e*, which feed downward into four Y-junctions 751*a-d* on the lower level of the device, which in turn branch into two branches each, at the end of each of which an output aperture (not shown in FIG. 7) feeds upwards into the spiral millimeter wave antennas 759*a-h*. In some embodiments according to the present disclosure, a spiral millimeter wave antenna and an input channel aperture may be formed on different levels of a co-fired ceramic device. For example, in this embodiment, the waveguide channel aperture 727 serving as an input channel aperture is formed in on a lower level of the device, and the spiral millimeter wave antennas 759*a-h* are formed in an upper level of the device. According to this configuration, for example, spiral millimeter wave antennas may be more flexibly arranged in the device. In addition, in some embodiments, for example, the number of spiral millimeter wave antennas which can be arranged in the device may be increased.

FIG. 8A is a schematic side view diagram of a spiral millimeter wave antenna 859 to which a co-fired ceramic device may be coupled, and FIG. 8B is a schematic top view diagram of such a spiral millimeter wave antenna 859, in accordance with an embodiment of the present disclosure. In FIG. 8A, the spiral antenna 859 is formed in a ceramic dielectric material 867, such as HF7 material sold by Epcos AG (herein, "TDK Epcos") of Munich, Bavaria, Germany, a subsidiary of TDK Corporation of Tokyo, Japan. A metallic layer 869 forms a ground layer, and includes an aperture (not shown) for input to the antenna 859. A thickness 871 of the ceramic dielectric 867 of the antenna can, for example, be less than about 5 mm, such as less than about 2 mm, although it will be appreciated that different dimensions can be used. The spiral antenna 859 includes spiral antenna arms 873*a*, 873*b*, which can be seen in the top view of FIG. 8B, and an input aperture 875 (see FIG. 8B). Rows of vias or posts 877 surround the antenna 859 (see FIG. 8A for side view, FIG. 8B for top view).

Figure 9A:
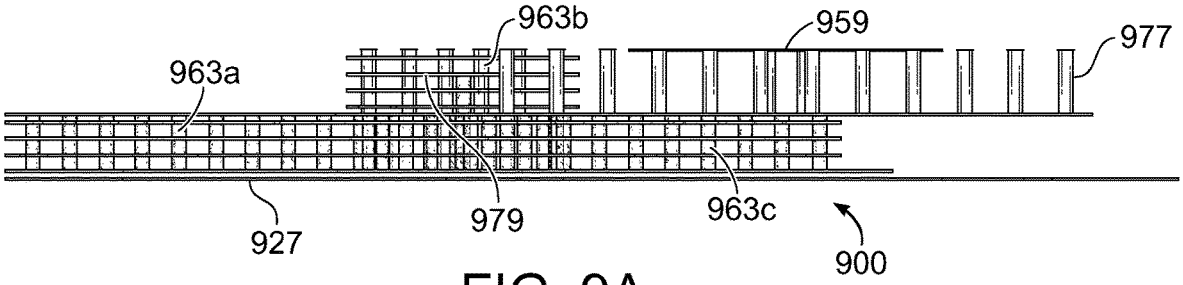
FIG. 9A is a schematic side view diagram of a co-fired ceramic device interfacing with spiral millimeter wave antennas.
Figure 9B:
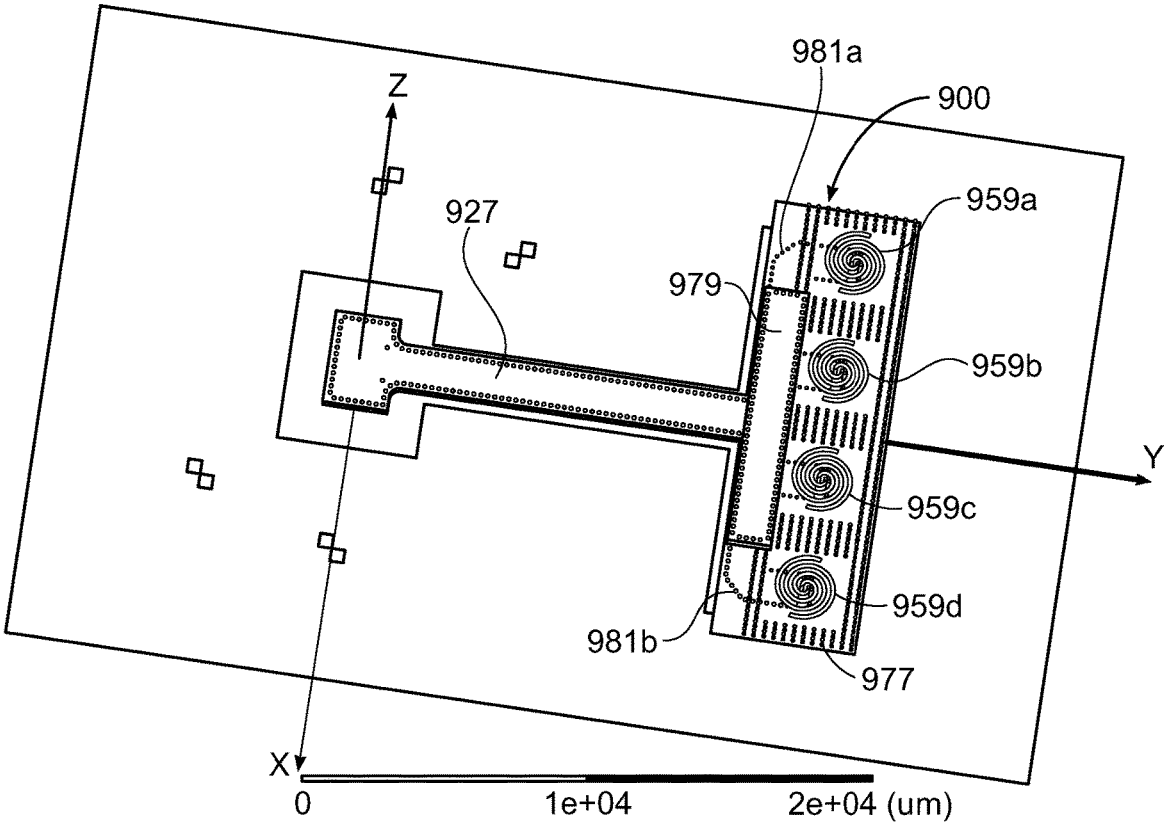
FIG. 9B is a corresponding schematic top view of the co-fired ceramic device and the spiral millimeter wave antennas, in accordance with an embodiment of the present disclosure.

FIG. 9A is a schematic side view diagram of a co-fired ceramic device 900 interfacing with spiral millimeter wave antennas 959, and FIG. 9B is a corresponding schematic top view of the co-fired ceramic device 900 and the spiral millimeter wave antennas 959*a-d*, in accordance with an embodiment of the present disclosure. In FIGS. 9A and 9B, a waveguide channel aperture 927 on a lower level has sidewalls formed by vias or posts 963*a* (see FIG. 9A), and feeds into a waveguide channel aperture 979 on an upper level, which has sidewalls formed by vias or posts 963*b* (see FIG. 9A). That waveguide channel aperture 979, in turn, feeds into waveguide channel apertures 981*a, b* on the lower level, which likewise have sidewalls formed by vias or posts 963*c* (see FIG. 9A). Those waveguide channel apertures 981*a, b*, in turn, feed up into spiral millimeter wave antennas 959*a-d* on the upper level. Rows of vias or posts 977 surround the antennas 959*a-d*.

Figure 10:
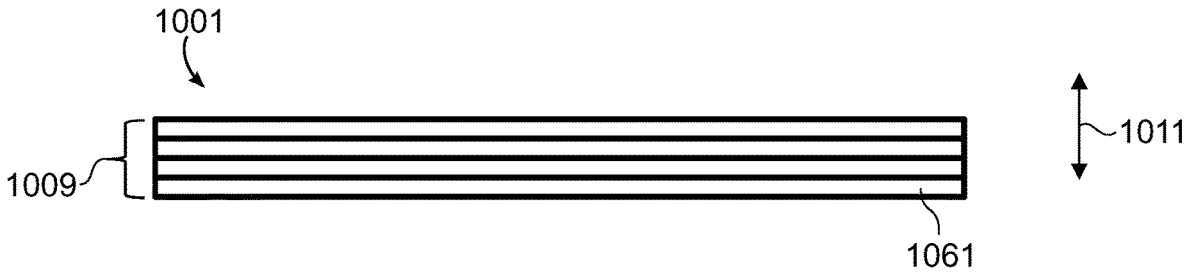
FIG. 10 is a schematic diagram illustrating ceramic layers that are co-fired to create a substrate of a co-fired ceramic waveguide device in accordance with an embodiment of the present disclosure.

FIG. 10 is a schematic diagram illustrating the ceramic layers 1061 that are co-fired to create a substrate 1001 of a co-fired ceramic waveguide device in accordance with an embodiment of the present disclosure. The device can include a plurality of co-fired substrate layers 1061 each including at least one ceramic material. The plurality of co-fired ceramic layers 1061 are stacked in the normal direction 1011, and each ceramic layer 1061 can, for example, be less than about 100 microns in thickness, such as less than about 10 microns in thickness. The co-fired ceramic layers 1061 can be integrated by being co-fired at a temperature less than about 1000° C., in which case the substrate is a low temperature co-fired ceramic (LTCC) device. Alternatively, the device can be a high temperature co-fired ceramic (HTCC) device, if fired at a higher temperature. The thickness 1009 of the device in the normal direction 1011 can, for example, be less than about 5 millimeters, such as less than about 2 millimeters or less than about 1 millimeter. In fabrication of the co-fired ceramic device in accordance with an embodiment of the present disclosure, the substrate layers 1061 can be made layer by layer; a ceramic layer is deposited, patterned (for example with vias and conductive layers); further such layers are made; and then the layers are co-fired together in the desired temperature range, such as by sintering in a kiln. Precision LTCC manufacturing processes can be used to line up vias together to form waveguide channel apertures within the substrate.

In operation of an embodiment according to the present disclosure, a method includes transmitting millimeter wavelength electromagnetic waves through a co-fired ceramic waveguide device. With reference to FIG. 2, the method includes transmitting the millimeter wavelength electromagnetic waves through at least one waveguide channel aperture 227, 231 within the co-fired ceramic substrate 201. The millimeter wavelength electromagnetic waves are transmitted through a first waveguide channel aperture 227 extending along at least part of a first waveguide channel level 229 of at least two different waveguide channel levels 229, 233, and are transmitted through a second waveguide channel aperture 231 extending along at least a portion of a second waveguide channel level 233 of the at least two different waveguide channel levels 229, 233. The method includes transmitting the millimeter wavelength electromagnetic waves through the at least one waveguide probe 235 within the co-fired ceramic substrate 201, the at least one waveguide probe opening at a first probe end 237 into the first waveguide channel aperture 227, and opening at a second probe end 239 into the second waveguide channel aperture 231. The method further includes transmitting the millimeter wavelength electromagnetic waves through more than one waveguide channel branches 238*a*, 238*b* which extend along a same level of the at least two different waveguide channel levels 229, 233 and extend in a direction parallel 219 to the at least one surface 213 of the device. The method can include one or more of: dividing the millimeter wavelength electromagnetic waves between the at least one waveguide input aperture 205 and the at least one waveguide output aperture 207, and combining the millimeter wavelength electromagnetic waves between the at least one waveguide input aperture 205 and the at least one waveguide output aperture 207. The method can include transmitting the millimeter wavelength electromagnetic waves from the at least one waveguide output aperture 207 into at least one millimeter wave antenna 659 (see FIG. 6). The method can include transmitting the millimeter wavelength electromagnetic waves with a different electric field polarization through at least one of the at least one waveguide output apertures 207 as compared with at least one of the at least one waveguide input apertures 205. Because of the axial symmetry of the waveguide probes, the polarization can be changed between the input and output apertures. Since different sections of the feeding network, located in different layers, are connected using symmetrical probes and apertures, the designer can easily control and manipulate each channel's polarization. The method can, for example, include transmitting the millimeter wavelength electromagnetic waves with a frequency between about 30 GHz and about 300 GHz, such as with a frequency between about 30 GHz and about 110 GHz, or with a frequency between about 110 GHz and about 300 GHz.

As used herein, a waveguide probe is "axially symmetric" about an axis if its appearance is unchanged when the waveguide probe is rotated any amount about the axis.

As used herein, a "millimeter wavelength electromagnetic wave" is an electromagnetic wave with a frequency between about 30 GHz and about 300 GHz and a wavelength between about 1 millimeter and about 1 centimeter; such as between about 30 GHz and about 110 GHz frequency, with a wavelength between about 2.73 mm and about 1 centimeter; or between about 110 GHz and about 300 GHz frequency, with a wavelength between about 1 mm and about 2.73 mm.

As used herein, a numerical quantity indicated as being "about" a given numerical value can, for example, be within about 10% of the given numerical value, such as within about 5% of the given numerical value, for example within about 1% of the given numerical value, or may be equal to the given numerical value.

Although various example dimensions are given herein for aspects of the present disclosure implemented in co-fired ceramic substrates, such as the sizes of caps, stems and waveguide channel apertures, it should be appreciated that dimensions can depend on the fabrication technology that is used, and can be varied.

As used herein, a "co-fired ceramic" device is a monolithic, ceramic device in which the ceramic support structure and conductive, resistive and dielectric materials used in it are fired in a kiln at the same time. The co-fired ceramic devices can, for example, be made by processing multiple ceramic layers separately and assembling them into a co-fired device. A co-fired ceramic device can be a low temperature co-fired ceramic (LTCC) device, if fired in a kiln at a sintering temperature below about 1000° C., particularly between about 850° C. and 950° C., and can be a high temperature co-fired ceramic (HTCC) device, if fired in a kiln at a sintering temperature above about 1000° C., particularly between about 1600° C. and 1800° C. LTCC devices can, for example, be made of multiple layers of materials such as glass and alumina oxide that are co-fired together. HTCC devices can, for example, be made of multiple layers of alumina oxide that are co-fired together. In one example, an LTCC device can include an HF7 LTCC material sold by Epcos AG (herein, "TDK Epcos") of Munich, Bavaria, Germany, a subsidiary of TDK Corporation of Tokyo, Japan. The LTCC material can, for example, have a high relative permittivity, such as a relative permittivity of 7 or more, or 8 or more, or of 12 or more; for example a relative permittivity of between about 7 and 12, such as between about 7 and 9. In one example, the LTCC material is HF7 sold by TDK Epcos, the co-firing temperature has a peak of about 915° C., the relative permittivity is 7.7 at 79 GHz, or 7.9 at 79 GHz with the inner metal included in the LTCC device, the fired ceramic layer thickness is less than about 30 μm, such as less than about 20 μm, and the via diameter is about 100 μm or less, such as about 80 μm. It will be appreciated that other materials, properties and dimensions can be used.

While example embodiments have been particularly shown and described, it will be understood by those skilled in the art that various changes in form and details may be made therein without departing from the scope of the embodiments encompassed by the appended claims.

What is claimed is:

1. A co-fired ceramic waveguide device for guiding electromagnetic waves, the device comprising:

a co-fired ceramic substrate comprising a thickness, in a normal direction perpendicular to at least one surface of the device, the thickness being less than a width of the co-fired ceramic substrate in a direction parallel to the surface of the device;

the co-fired ceramic substrate comprising at least one waveguide channel aperture formed within the co-fired ceramic substrate, a first waveguide channel aperture being formed in the at least one waveguide channel aperture and extending along at least a portion of a first waveguide channel level of at least two different waveguide channel levels, and a second waveguide channel aperture being formed in the at least one waveguide channel aperture and extending along at least a portion of a second waveguide channel level of the at least two different waveguide channel levels, the at least two different waveguide channel levels being at different levels in the normal direction within the co-fired ceramic substrate;

the co-fired ceramic substrate further comprising at least one waveguide probe formed within the co-fired ceramic substrate, opening at a first probe end into the first waveguide channel aperture, and opening at a second probe end into the second waveguide channel aperture; and at least one of the first waveguide channel aperture and the second waveguide channel aperture being divided into more than one waveguide channel branches extending along a same level of the at least two different waveguide channel levels and extending in a direction parallel to the at least one surface of the device.

2. The device of claim 1, wherein the at least one waveguide probe is formed in an axially symmetric manner about an axis extending between the first waveguide channel level and the second waveguide channel level.

3. The device of claim 2, wherein the at least one waveguide probe is formed to comprise a stem.

4. The device of claim 3, wherein the at least one waveguide probe is formed to comprise at least one cap.

5. The device of claim 4, wherein the at least one cap is formed to comprise a cap opening onto the first probe end, and wherein the stem is formed to open onto the second probe end.

6. The device of claim 4, wherein the at least one cap is formed to comprise a first cap opening onto the first probe end, and to comprise a second cap opening onto the second probe end.

7. The device of claim 1, wherein the more than one waveguide channel branches are formed to comprise at least one of: a T-shaped junction of more than one waveguide channel branches, a Y-shaped junction of more than one waveguide channel branches, and a cross-shaped junction of more than one waveguide channel branches.

8. The device of claim 1, wherein the at least one waveguide channel aperture is formed to comprise a width less than about 1 millimeter.

9. The device of claim 1, further comprising:

at least one waveguide input aperture formed in the co-fired ceramic substrate;

at least one waveguide output aperture formed in the co-fired ceramic substrate; and the at least one waveguide input aperture, the at least one waveguide channel aperture, the at least one waveguide probe and the at least one waveguide output aperture being formed to together comprise a waveguide network connecting the at least one waveguide input aperture with the at least one waveguide output aperture.

10. The device of claim 9, wherein the at least one waveguide probe is formed to couple at least one of the at least one waveguide input aperture and the at least one waveguide output aperture to at least one of: a different one of the at least one waveguide input aperture, a different one of the at least one waveguide output aperture, and the at least one waveguide channel aperture.

11. The device of claim 9, further comprising at least one millimeter wave antenna coupled to the at least one waveguide output aperture of the co-fired ceramic substrate.

12. The device of claim 11, wherein the at least one millimeter wave antenna and the at least one waveguide input aperture are formed in a different level of the at least two different waveguide channel levels.

13. The device of claim 1, the co-fired ceramic substrate comprising a plurality of co-fired substrate layers each comprising at least one ceramic material, the plurality of co-fired ceramic layers being stacked in the normal direction and each ceramic layer being less than about 100 microns in thickness, the plurality of co-fired ceramic layers being integrated by having been co-fired at a temperature less than about 1000° C.

14. A method of transmitting electromagnetic waves through a co-fired ceramic waveguide device, the method comprising:

transmitting the electromagnetic waves through at least one waveguide channel aperture within a co-fired ceramic substrate, the co-fired ceramic substrate comprising a thickness, in a normal direction perpendicular to at least one surface of the device, the thickness being less than a width of the co-fired ceramic substrate in a direction parallel to the surface of the device;

the transmitting through the at least one waveguide channel aperture comprising transmitting the electromagnetic waves through a first waveguide channel aperture extending along at least a portion of a first waveguide channel level of at least two different waveguide channel levels, and transmitting the electromagnetic waves through a second waveguide channel aperture extending along at least a portion of a second waveguide channel level of the at least two different waveguide channel levels, the at least two different waveguide channel levels being at different levels in the normal direction within the co-fired ceramic substrate;

transmitting the electromagnetic waves through at least one waveguide probe within the co-fired ceramic substrate, the at least one waveguide probe opening at a first probe end into the first waveguide channel aperture, and opening at a second probe end into the second waveguide channel aperture; and transmitting the electromagnetic waves through more than one waveguide channel branches of at least one of the first waveguide channel aperture and the second waveguide channel aperture, the more than one waveguide channel branches extending along a same level of the at least two different waveguide channel levels and extending in a direction parallel to the at least one surface of the device.

15. The method of claim 14, further comprising:

transmitting the electromagnetic waves through a waveguide network of the device, the waveguide network comprising at least one waveguide input aperture of the device, the at least one waveguide probe, at least one waveguide output aperture of the device, and the at least one waveguide channel aperture.

16. The method of claim 15, comprising at least one of: dividing the electromagnetic waves between the at least one waveguide input aperture and the at least one waveguide output aperture, and combining the electromagnetic waves between the at least one waveguide input aperture and the at least one waveguide output aperture.

17. The method of claim 15, comprising transmitting the electromagnetic waves from the at least one waveguide output aperture into at least one millimeter wave antenna.

18. The method of claim 17, comprising transmitting, through the waveguide network, the electromagnetic waves from the at least one waveguide input aperture to the at least one waveguide output aperture, which is coupled to the at least one millimeter wave antenna, wherein the at least one millimeter wave antenna and the at least one waveguide input aperture are formed in a different level of the at least two different waveguide channel levels.

19. The method of claim 15, comprising transmitting the electromagnetic waves with a different electric field polarization through at least one of the at least one waveguide output apertures as compared with at least one of the at least one waveguide input apertures.

20. The method of claim 15, comprising transmitting the electromagnetic waves with a frequency between about 30 GHz and about 300 GHz.

* * * * *